US012372315B2

(12) United States Patent
Smathers et al.

(10) Patent No.: US 12,372,315 B2
(45) Date of Patent: Jul. 29, 2025

(54) FIREARM FRAME WITH A RELIEF

(71) Applicant: OA DEFENSE LLC, Dayton, NV (US)

(72) Inventors: Joseph Smathers, Dayton, NV (US); Todd Powers, Dayton, NV (US)

(73) Assignee: OA DEFENSE LLC, Dayton, NV (US)

( * ) Notice: Subject to any disclaimer, the term of this patent is extended or adjusted under 35 U.S.C. 154(b) by 0 days.

(21) Appl. No.: 18/219,514

(22) Filed: Jul. 7, 2023

(65) Prior Publication Data

US 2024/0035762 A1 Feb. 1, 2024

Related U.S. Application Data

(60) Provisional application No. 63/393,891, filed on Jul. 30, 2022.

(51) Int. Cl.
*F41A 3/64* (2006.01)

(52) U.S. Cl.
CPC ..... *F41A 3/64* (2013.01)

(58) Field of Classification Search
CPC ..... F41A 3/64
USPC ..... 89/162, 194, 195, 160; 42/7, 16, 17, 20, 42/21
See application file for complete search history.

(56) References Cited

U.S. PATENT DOCUMENTS

| | | | | |
|---|---|---|---|---|
| 984,519 | A | 2/1911 | Browning | |
| 1,410,266 | A | 3/1922 | Pedersen | |
| 1,618,510 | A * | 2/1927 | Browning | F41A 19/30 89/154 |
| 3,365,829 | A | 1/1968 | Shockey | |
| 3,682,040 | A | 8/1972 | Roy | |
| 4,023,296 | A | 5/1977 | Frisoli | |
| 4,109,403 | A * | 8/1978 | Badali | F41A 21/484 42/75.02 |
| 4,232,583 | A * | 11/1980 | Harrison | F41A 3/44 89/173 |
| 4,338,740 | A | 7/1982 | Miller | |
| 4,539,770 | A | 9/1985 | Bornancini | |
| 4,593,487 | A | 6/1986 | Ruger | |
| 4,681,020 | A * | 7/1987 | Polanecky | F41A 35/06 89/196 |
| 4,709,497 | A | 12/1987 | Resca | |
| 6,116,137 | A | 9/2000 | Strahan | |
| 6,205,694 | B1 | 3/2001 | Resca | |
| 9,068,790 | B2 | 6/2015 | La Vigne | |
| 9,696,101 | B2 * | 7/2017 | Kada | F41A 3/56 |
| 10,794,648 | B2 | 10/2020 | Henninger et al. | |
| 2006/0064914 | A1 * | 3/2006 | Greer | F41A 11/02 42/77 |
| 2013/0269233 | A1 | 10/2013 | Chin | |

(Continued)

FOREIGN PATENT DOCUMENTS

WO 2018102458 A2 6/2018

OTHER PUBLICATIONS

International Search Report and Written Opinion dated Oct. 19, 2023 issued in PCT/US2023/29136.

*Primary Examiner* — John Cooper
(74) *Attorney, Agent, or Firm* — HUNTON ANDREWS KURTH LLP

(57) ABSTRACT

Firearm with a relief for debris. The relief can sit below where the barrel would typically sit once assembled with the frame. The relief can be shaped such that the debris that would typically be held in the barrel void would instead fall into the relief.

21 Claims, 5 Drawing Sheets

(56) References Cited

U.S. PATENT DOCUMENTS

| | | | | |
|---|---|---|---|---|
| 2016/0047613 | A1* | 2/2016 | Hudson, III | F41A 19/10<br>42/14 |
| 2017/0030673 | A1* | 2/2017 | Lee | F41A 11/00 |
| 2017/0108304 | A1* | 4/2017 | Heizer | F41C 3/00 |
| 2018/0058792 | A1 | 3/2018 | Schirmer | |
| 2019/0041150 | A1 | 2/2019 | Lopata et al. | |
| 2019/0137206 | A1 | 5/2019 | Lopata | |
| 2020/0025501 | A1 | 1/2020 | Price | |
| 2021/0131764 | A1 | 5/2021 | Padovan | |

* cited by examiner

FIREARM FRAME WITH A RELIEF

CROSS-REFERENCE TO RELATION APPLICATIONS

This application claims priority to U.S. Provisional Application No. 63/393,891 filed Jul. 30, 2022, which application is incorporated by reference herein. This application also relates to U.S. Pat. No. 984,519 filed on Feb. 17, 1910, the contents of which are incorporated herein in its entirety.

FIELD OF THE DISCLOSURE

The present disclosure relates to reliefs in the frames of firearms.

BACKGROUND

Hand pistols taught by U.S. Pat. No. 984,519, or some variation thereof, (each a "1911") have been in production for over one-hundred years. During that time, the 1911 has developed a loyal following for a variety of reasons. Unfortunately, certain features of the 1911 are not optimized.

A 1911 includes a frame, a hammer pivotally coupled to an upper portion of the frame, a slide slidably coupled to the frame and forming a void therebetween (the "barrel void"), and a barrel positioned at least partially within the barrel void. The barrel is coupled to the frame and operably linked to the slide such that movement of the slide causes the barrel to move as well. In particular, the barrel rocks backward towards a loading position as the slide moves backwards towards a cocking position. After cocking and loading the firearm, the slide and the barrel move simultaneously back to their respective firing positions. Unfortunately, the 1911 is at least somewhat susceptible to debris migrating into internal areas of the firearm, such as the barrel void. Once inside the firearm, the debris can collect in one or more working joints of the firearm (and/or can collect in one or more other areas) in such a way as to cause unnecessary wear or other damage. Accordingly, it would be beneficial to have a 1911-style firearm that includes provisions for mitigating risk associated with debris.

Of particular concern is debris migrating into the barrel of the 1911, such as through the breech of the barrel during a loading operation for the firearm. Accordingly, it would be beneficial to have a 1911-style firearm that includes provisions for directing debris away from the breech of the barrel.

SUMMARY OF THE DISCLOSURE

In some aspects, the techniques described herein relate to a firearm including: a slide assembly; a barrel; a frame configured mate with the slide assembly, wherein the frame and the slide assembly can house the barrel, wherein the frame includes an inner surface; a relief in the inner surface of the frame wherein the relief is coaxially situated on the inner surface of the frame; and a barrel lug configured to removably attach the barrel to the frame, wherein the barrel lug further includes a first flute and a second flute.

In some aspects, the techniques described herein relate to a firearm including: a slide assembly; a barrel; a frame configured mate with the slide assembly, wherein the frame and the slide assembly can house the barrel, wherein the frame includes an inner surface; and a relief in the inner surface of the frame wherein the relief is coaxially situated on the inner surface of the frame.

In some aspects, the techniques described herein relate to a firearm frame including: an inner surface; and a relief in the inner surface of the frame wherein the relief is coaxially situated on the inner surface of the frame.

Further features of the disclosed systems and methods, and the advantages offered thereby, are explained in greater detail hereinafter with reference to specific example embodiments illustrated in the accompanying drawings.

BRIEF DESCRIPTION OF THE DRAWINGS

In order to facilitate a fuller understanding of the present invention, reference is now made to the attached drawings. The drawings should not be construed as limiting the present invention, but are intended only to illustrate different aspects and embodiments of the invention.

DETAILED DESCRIPTION

Figure 1:
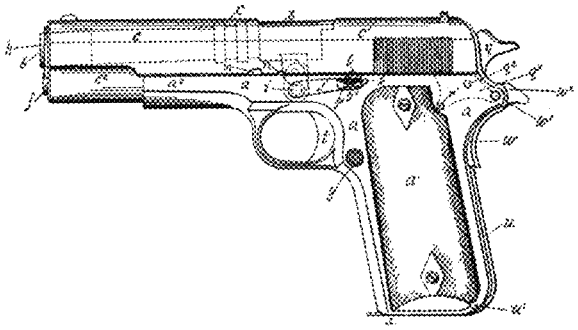
FIG. 1 is side view of a hand pistol of the prior art, the image taken from U.S. Pat. No. 984,519, the pistol shown in a rest configuration.

Exemplary embodiments of the invention will now be described in order to illustrate various features of the invention. The embodiments described herein are not intended to be limiting as to the scope of the invention, but rather are intended to provide examples of the components, use, and operation of the invention.

Furthermore, the described features, advantages, and characteristics of the embodiments may be combined in any suitable manner. One skilled in the relevant art will recognize that the embodiments may be practiced without one or more of the specific features or advantages of an embodiment. In other instances, additional features and advantages may be recognized in certain embodiments that may not be present in all embodiments.

The present invention comprises a modified 1911 hand pistol (the "2311"). The 2311 is similar enough to a 1911 to satisfy most loyalists, while resolving certain deficiencies associated with the 1911. Like the 1911, the 2311 includes a barrel void positioned between a frame and a slide. Both firearms also include a barrel positioned at least partially within the barrel void. Unlike the 1911, an inner surface of the frame of the 2311 defines a relief in communication with the barrel void (or forming part of the barrel void, as the case may be), the relief being configured to capture debris, thereby mitigating risk associated with the debris. Furthermore, some embodiments of the 2311 include provisions for directing debris away from a breech of the barrel.

The debris management elements provide several benefits over conventional handguns. For example, the debris management elements can enhance reliability of the handgun. Debris, such as dirt, dust, or small particles, can disrupt the smooth functioning of the firearm's moving parts. By reducing the risk of debris entering the internal areas, particularly the barrel void, the firearm's reliability and overall performance can be improved. Unwanted debris can cause malfunctions, misfeeds, or other operational issues, leading to potential failures or delays in critical situations. Furthermore, the debris management system can reduce the need to maintain the handgun and in turn improve durability. Debris accumulation in working joints or other areas of the firearm can contribute to increased wear and tear. Over time, this can lead to mechanical problems and a decrease in the firearm's lifespan. By designing the 1911-style firearm with better debris mitigation, the need for frequent cleaning, maintenance, and repairs can be reduced, ensuring long-term durability and minimizing downtime. Furthermore, these elements will improve consistency and accuracy of the handgun in use. Any foreign material present in the barrel or other critical areas of the firearm can affect the accuracy and consistency of the shots. Even small debris particles can disrupt the trajectory of the bullet or affect the timing of the firearm's cycling mechanism. By minimizing debris intrusion, the firearm can maintain its intended precision and consistency, crucial for accurate shooting. Finally, these debris management elements will improve safety and functionality. A clean and well-maintained firearm is essential for safe operation. Debris inside the firearm can potentially interfere with safety mechanisms or cause unintended behavior, posing a safety risk to the shooter and those in proximity. Improving debris mitigation in the 1911-style firearm ensures that it operates as intended, reducing the likelihood of accidental discharges or other safety-related issues. In summary, enhancing the debris mitigating elements of the 1911-style firearm leads to improved reliability, reduced maintenance requirements, increased durability, consistent accuracy, and enhanced safety. These benefits collectively contribute to a more effective and reliable firearm for the user.

FIG. 1 is side view of a hand pistol of the prior art, the image taken from U.S. Pat. No. 984,519 (FIG. 1), the pistol shown in a rest configuration.

Figure 2:
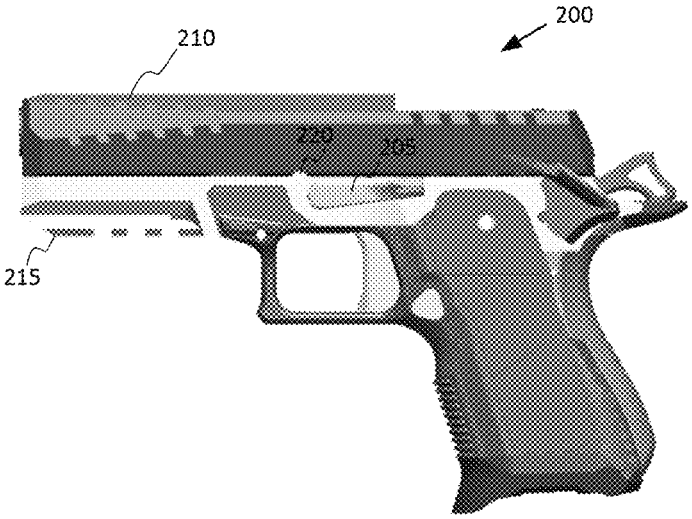
FIG. 2 is a sectional side view of a hand pistol of the present invention.

FIG. 2 illustrates a firearm 200 of the present application including a frame 215, a slide 210 slidably coupled to the frame 215, and a slide stop 205 coupled to the frame 215, the slide stop 205 being configured to move in and out of engagement with the slide 210, thereby locking or releasing the slide, respectively. The slide stop 205 can be configured to engage with the slide stop notch 220 thereby stopping the slide 210 from moving.

Figure 3A:
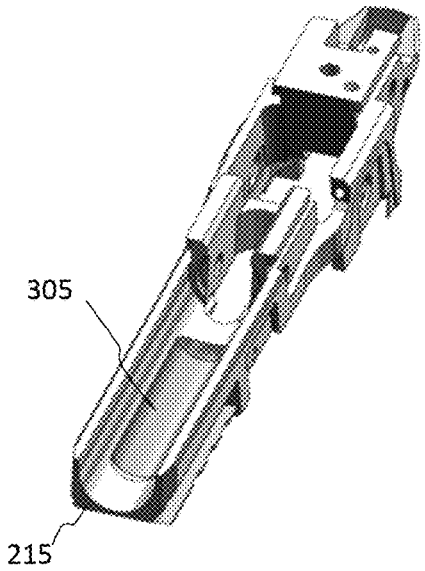
FIG. 3A is an elevation view of a portion of the frame with a relief.
Figure 3B:
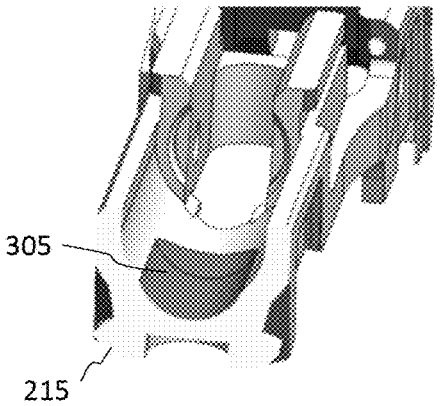
FIG. 3B is an enlarged portion of FIG. 3A.
Figure 3C:
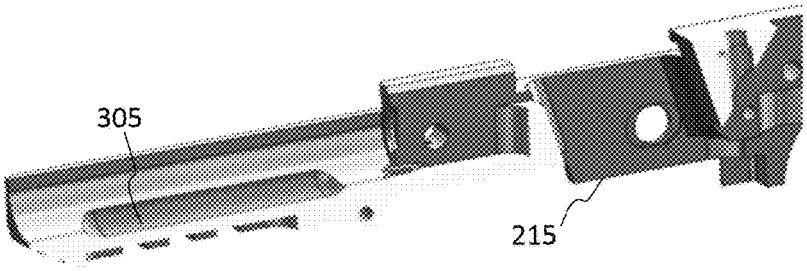
FIG. 3C is a partial sectional view of a portion of the frame shown in FIG. 3A.

Referring to FIGS. 3A-3C is an elevation view of a portion of the frame 215 with a relief 305. The relief 305 can sit below where the barrel 405 would typically sit once assembled with the frame 215. The relief 305 can be shaped such that the debris that would typically be held in the barrel void would instead fall into the relief 305. The relief 305 can sit coaxially within the portion of the frame 215 that typically holds the barrel 405. The relief 305 can vary in length in different embodiments. In some embodiments, the relief 305 can have sharp or curved edges, or even sheer walls conducive to trapping debris. In still other embodiments, the relief can have beveled or chamfered edges.

Figure 4A:
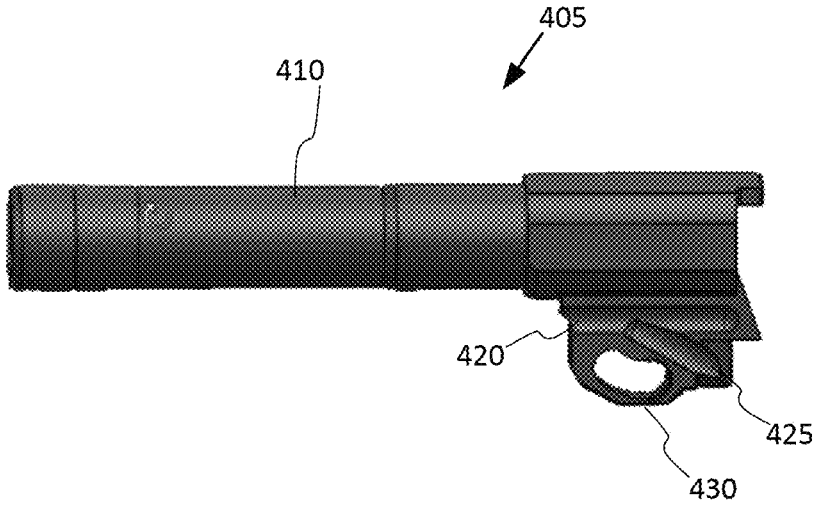
FIG. 4A is a slide elevation view of a barrel.
Figure 4B:
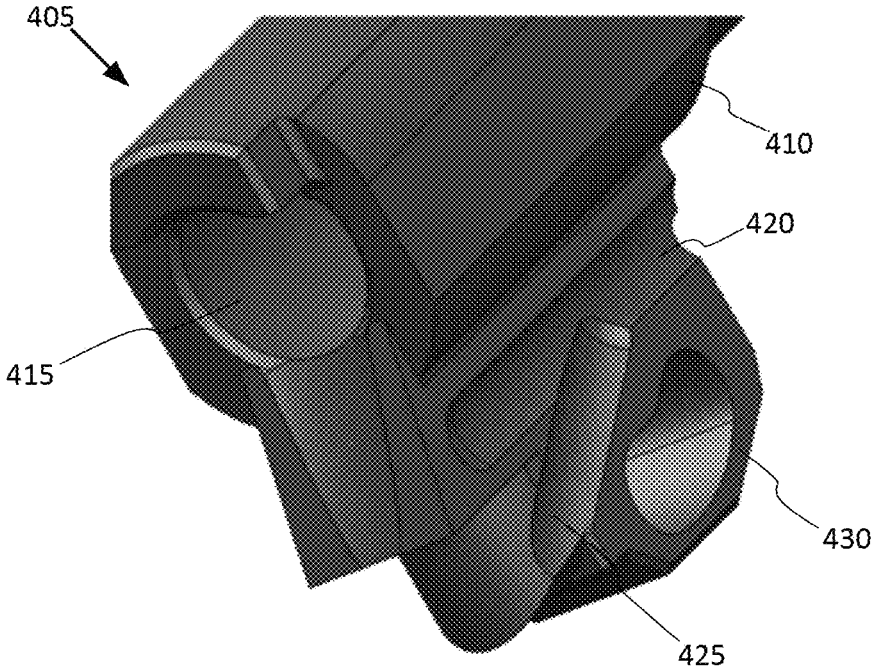
FIG. 4B shows a partial perspective view of the barrel.

In FIGS. 4A-4B, the barrel 405 can have a cylindrical body, a barrel exterior 410, a barrel interior 415, and a barrel lug 430 configured to be coupled to the frame 215 so as to facilitate rocking the barrel 405 between loading and firing positions. The barrel 405 can further include on the barrel lug 430 with a first flute 420 and a second flute 425, each flute being designed to direct debris away from barrel interior 415. A first flute 420 and second flute 425 can be present on both sides of the barrel lug 430. The first flute 420 extends from the front of the barrel lug 430 towards the rear of the barrel lug 430 such that the first flute is parallel with the barrel 405. The second flute 425 can extend down at an angle such that the second flute 425 is angled relative to the barrel 405. The first flute 420 and the second flute 425 can intersect such that the opening of the second flute 425 is within the first flute 420.

Figure 5:
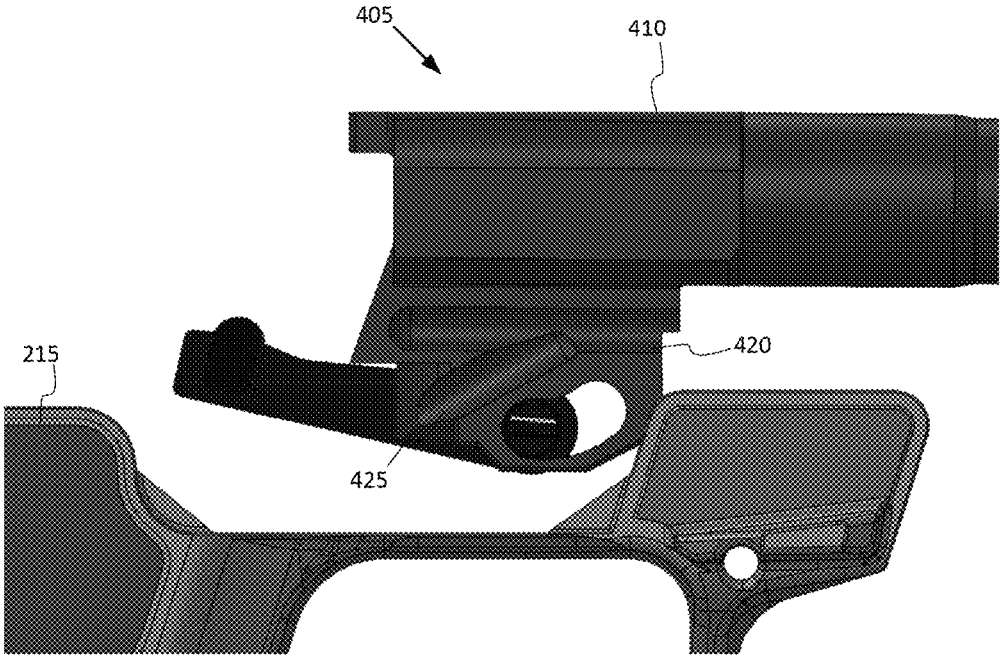
FIG. 5 shows a side elevation view of the barrel and the frame.

FIG. 5 shows a side elevation view of the barrel 405 and the frame 215.

In some aspects, the techniques described herein relate to a firearm including: a slide assembly; a barrel; a frame configured mate with the slide assembly, wherein the frame and the slide assembly can house the barrel, wherein the frame includes an inner surface; a relief in the inner surface of the frame wherein the relief is coaxially situated on the inner surface of the frame; and a barrel lug configured to removably attach the barrel to the frame, wherein the barrel lug further includes a first flute and a second flute.

In some aspects, the techniques described herein relate to a firearm, wherein relief is below a placement of the barrel within the frame when barrel is assembled with the frame.

In some aspects, the techniques described herein relate to a firearm, wherein the barrel has a cylindrical body, and exterior, and an interior.

In some aspects, the techniques described herein relate to a firearm, wherein the relief is configured to capture debris in between the barrel and the interior of the frame.

In some aspects, the techniques described herein relate to a firearm, wherein first flute and the second flute are configured to direct debris away from the interior of the frame.

In some aspects, the techniques described herein relate to a firearm, wherein the first flute is parallel to the barrel.

In some aspects, the techniques described herein relate to a firearm, wherein the second flute is at an angle relative to the barrel.

In some aspects, the techniques described herein relate to a firearm, wherein the barrel lug facilitates a rocking movement of the barrel between loading and firing positions of the firearm.

In some aspects, the techniques described herein relate to a firearm, wherein the firearm includes a plurality of reliefs in the inner surface of the frame.

In some aspects, the techniques described herein relate to a firearm, wherein the barrel lug includes three or more flutes configured to direct debris away from the interior of the frame.

In some aspects, the techniques described herein relate to a firearm including: a slide assembly; a barrel; a frame configured mate with the slide assembly, wherein the frame and the slide assembly can house the barrel, wherein the frame includes an inner surface; and a relief in the inner surface of the frame wherein the relief is coaxially situated on the inner surface of the frame.

In some aspects, the techniques described herein relate to a frame, wherein relief is below a placement of the barrel within the frame when barrel is assembled with the frame.

In some aspects, the techniques described herein relate to a frame, wherein the barrel has a cylindrical body, and exterior, and an interior.

In some aspects, the techniques described herein relate to a frame, wherein the relief is configured to capture debris in between the barrel and the interior of the frame.

In some aspects, the techniques described herein relate to a frame, wherein the firearm includes a plurality of reliefs in the inner surface of the frame.

In some aspects, the techniques described herein relate to a frame, wherein the relief has chamfered edges.

In some aspects, the techniques described herein relate to a frame, wherein the relief has sharp edges.

In some aspects, the techniques described herein relate to a frame, wherein the relief has curved edges.

In some aspects, the techniques described herein relate to a frame, wherein the relief within the frame includes sheer walls with a textured surface. This area can have a textured pattern, such as stippling, checkering, or grooves, which facilitate the accumulation of debris.

In some aspects, the techniques described herein relate to a frame, wherein the relief within includes a length that extends less than half of the entire inner surface.

In some aspects, the techniques described herein relate to a firearm frame including: an inner surface; a relief in the inner surface of the frame wherein the relief is coaxially situated on the inner surface of the frame.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above-described embodiments, method, and examples, but by all embodiments within the scope and spirit of the invention as claimed.

It is understood that some or all of the devices or elements thereof can be made or manufactured out of one or more materials. These materials can include without limitation: steel; stainless steel; aluminum; titanium; a zinc alloy; brass; polymer; fiberglass; thermoplastic; polyethylene; polyamide; polycarbonate; and polypropylene. The use of different materials for the first and second portions of the slide stop offers several advantages. By allowing a combination of metal, polymer, and composite materials, the firearm manufacturer can optimize the slide stop's performance and functionality.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the invention as oriented in the figures and is not to be construed as limiting any feature to be a particular orientation, as said orientation may be changed based on the user's perspective of the device.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

The invention is not to be limited in terms of the particular embodiments described herein, which are intended as illustrations of various aspects. Many modifications and variations can be made without departing from its spirit and scope. Functionally equivalent systems, processes and apparatuses within the scope of the invention, in addition to those enumerated herein, may be apparent from the representative descriptions herein. Such modifications and variations are intended to fall within the scope of the appended claims. The invention is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

What is claimed is:

1. A firearm comprising:

a slide assembly;

a barrel;

a frame configured mate with the slide assembly, wherein the frame and the slide assembly house the barrel, wherein the frame comprises an inner surface;

a relief in the inner surface of the frame wherein the relief is coaxially situated on the inner surface of the frame proximate a muzzle end of the barrel and is shaped to capture debris not to provide a void for a component to function; and a barrel lug configured to removably attach the barrel to the frame, wherein the barrel lug further comprises a first flute and a second flute.

2. The firearm of claim 1, wherein the relief is below a placement of the barrel within the frame when the barrel is assembled with the frame.

3. The firearm of claim 1, wherein the barrel has a cylindrical body, and exterior, and an interior.

4. The firearm of claim 1, wherein the relief is configured to capture debris in between the barrel and an interior of the frame.

5. The firearm of claim 1, wherein first flute and the second flute are configured to direct debris away from the inner surface of the frame.

6. The firearm of claim 1, wherein the first flute is parallel to the barrel.

7. The firearm of claim 1, wherein the second flute is at an angle relative to the barrel.

8. The firearm of claim 1, wherein the firearm comprises a plurality of reliefs in the inner surface of the frame.

9. The firearm of claim 1, wherein the barrel lug comprises three or more flutes configured to direct debris away from the inner surface of the frame.

10. A firearm comprising:

a slide assembly;

a barrel;

a frame configured to mate with the slide assembly, wherein the frame and the slide assembly house the barrel, wherein the frame comprises an inner surface and a distal muzzle end; and a relief in the inner surface of the frame wherein the relief is situated on the inner surface of the frame near the distal muzzle end of the frame and wherein the relief is shaped to capture debris and not to provide a void for a component to function.

11. The firearm of claim 10, wherein the relief is below a placement of the barrel within the frame when the barrel is assembled with the frame.

12. The firearm of claim 10, wherein the barrel has a cylindrical body, and exterior, and an interior.

13. The firearm of claim 10, wherein the relief is configured to capture debris in between the barrel and an interior of the frame.

14. The firearm of claim 10, wherein the firearm comprises a plurality of reliefs in the inner surface of the frame.

15. The firearm of claim 10, wherein the relief has chamfered edges.

16. The firearm of claim 10, wherein the relief has sharp edges.

17. The firearm of claim 10, wherein the relief has curved edges.

18. The firearm of claim 10, wherein the relief within the frame comprises sheer walls with a textured surface.

19. The firearm of claim 10, wherein the relief within comprises a length that extends less than half of the entire inner surface.

20. A firearm frame comprising:

an inner surface of the firearm frame and a distal muzzle end of the firearm frame; and a relief in the inner surface of the firearm frame, wherein the relief is coaxially situated on the inner surface of the firearm frame proximate the distal muzzle end of the firearm frame and wherein the relief is shaped to capture debris and not to provide a void for a component to function.

21. The firearm frame of claim 20, wherein the relief comprises at least one channel that terminates before the distal muzzle end of the firearm frame.

* * * * *